United States Patent [19]

Gilmer et al.

[11] 4,043,539

[45] Aug. 23, 1977

[54] METHOD AND APPARATUS FOR STATIC TYPE FLUID MIXING

[75] Inventors: William N. Gilmer, Chesterfield; Vernon M. Barnes, Jr., Richmond, both of Va.

[73] Assignee: Texaco Inc., New York, N.Y.

[21] Appl. No.: 563,048

[22] Filed: Mar. 28, 1975

[51] Int. Cl.[2] ..... B01F 15/00

[52] U.S. Cl. ..... 259/4 AB; 138/42

[58] Field of Search ..... 138/42, 113, 114; 259/4 R, 4 AB, 18, 36

[56] References Cited

U.S. PATENT DOCUMENTS

| | | | |
|---|---|---|---|
| 1,676,237 | 7/1928 | Baker | 259/4 AB |
| 2,200,788 | 5/1940 | Coy | 138/42 |
| 2,740,616 | 4/1956 | Walden | 259/4 AB |
| 2,777,467 | 1/1957 | Powell et al. | 259/4 AB |
| 3,207,484 | 9/1965 | Rubin | 259/4 AB |

FOREIGN PATENT DOCUMENTS

| | | | |
|---|---|---|---|
| 1,140 | 10/1967 | United Kingdom | 138/42 |

*Primary Examiner*—Richard E. Aegerter
*Assistant Examiner*—John W. Shepperd
*Attorney, Agent, or Firm*—Thomas H. Whaley; Carl G. Ries; Henry C. Dearborn

[57] ABSTRACT

A static-type fluid-mixing method. It deals with mixing different fluids in a stream which are separated longitudinally. A portion of the stream is diverted laterally and the remainder is reversed after continuing in the original direction for a given distance. Both parts are then mixed by joining one another down stream.

A static-type mixer. It has a conduit for carrying a stream of fluids separated longitudinally. It includes passages for diverting a portion of the stream laterally, and means for longitudinally reversing the remainder of the stream to rejoin the diverted portion after a given amount of flow of the stream.

4 Claims, 6 Drawing Figures

METHOD AND APPARATUS FOR STATIC TYPE FLUID MIXING

BACKGROUND OF THE INVENTION

1. Field of the Invention

This invention concerns fluid mixing devices in general, and more specifically relates to a method and/or apparatus for mixing fluids where the mixing is done by a static-type mixer.

2. Description of the Prior Art

In the field of fluid mixing there are in general two types of mixing devices or methods, one of which may be termed dynamic and the other static. It is the latter type to which the subject invention applies. What is meant by this differentiation is that there are no moving parts in the mixing apparatus of a static-type mixer. Dynamic type mixing may be very effective, but it involves the use of motor driven stirring elements or other moving parts in order to provide the desired mixing of different fluids. Obviously such equipment tends to be considerably more expensive, both to install and to operate and maintain.

In connection with static-type mixers, it has been found that known mixing structures may be quite effective under conditions where the different fluids to be mixed and that make-up the fluid stream, are running together in the stream in parallel fashion. However, this invention is particularly concerned with providing static-type mixing under conditions where the foregoing parallel flow type static mixing is relatively ineffective. Thus, if a fluid stream is made up of different fluids which are separated longitudinally e.g. in batches, the mixing which results is rather ineffective. It is particularly so in between the different batches of fluid where all of the mixing effects are acting upon a single fluid.

Consequently, it is an object of this invention to provide a static-type mixing method and/or apparatus which acts to give mixing that extends longitudinally along a stream of different fluids. The result is to effectively mix different fluids that exist in a stream with a batch type separation.

Another object of the invention is to provide an improved static-type mixer which employs no moving parts, and consequently is effective under conditions where a dynamic type mixer would not be feasible.

SUMMARY OF THE INVENTION

Briefly, the invention concerns a method of mixing fluids in a static-type mixer, which method comprises the steps of flowing a stream of a plurality of different fluids that are separated longitudinally relative to said stream, and separating said flowing stream by diverting a portion thereof transversely of the stream. It also comprises the step of longitudinally reversing the remainder of said flowing stream to rejoin said separated portion after a predetermined quantity of fluid flow.

Again briefly, the invention concerns a static-type mixer which comprises in combination a conduit for carrying a stream of a plurality of different fluids that are separated longitudinally therein, and means for laterally diverting a portion of said stream. It also comprises means for longitudinally reversing the remainder of said stream and rejoining said diverted portion.

Once more briefly, the invention concerns a static-type mixer which comprises in combination a first conduit for carrying a stream of fluid the constituents of which are separated longitudinally, and a first plurality of passages through the wall of said conduit for passing a portion of said stream laterally therethrough. It also comprises a first end wall on said conduit for reversing the flow of the remainder of said stream, the said end wall extends laterally beyond the walls of said conduit and forms an end wall of a second conduit which is concentric with said first conduit. It also comprises a second plurality of passages adjacent to said end wall for passing said remainder of said stream into said second conduit for reverse flow back toward said first passages, and a second end wall on said second conduit located down stream of said first plurality of passages relatively to said reverse flow. It also comprises a third plurality of passages through the outer wall of said second conduit for passing the mixture of said portion and said reverse flowing remainder of said stream. The said second end wall extends laterally beyond the walls of said second conduit and forms an end wall of a third conduit concentric with said first and second conduits for re-reversing said stream. It also comprises a fourth plurality of passages through the walls of said second conduit extended for passing a portion of said mixture laterally therethrough, and a third end wall extending from said third conduit inward beyond the walls of said second conduit for reversing the flow of the remainder of said mixture. It also comprises a fifth plurality of passages through the walls of said second conduit extended adjacent to said third end wall for passing said remainder of said mixture to said reverse flow in said second conduit extended, and a sixth plurality of passages through the walls of said first conduit extended adjacent to said first end wall for passing the additional mixture of said portion and remainder of the again divided mixture.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings wherein.

DESCRIPTION OF THE PREFERRED EMBODIMENTS

Figure 1:
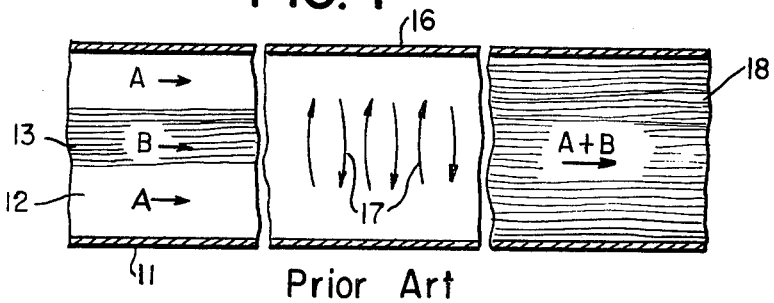
FIG. 1 is a schematic illustration showing some prior art mixing concepts.
Figure 2:
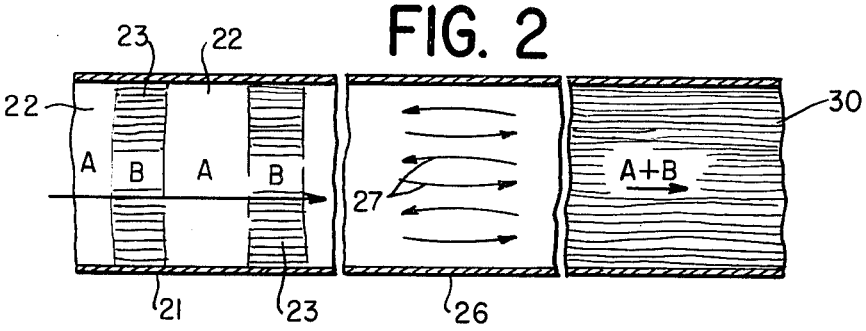
Prior Art FIG. 2
FIG. 2 is a schematic illustration showing the basic concepts of the type of mixing that is in accordance with this invention.

FIGS. 1 and 2 are schematic illustrations indicating the principles of mixing effects which may be obtained using static-type mixing according to the prior art (FIG. 1) and according to this invention (FIG. 2). As indicated above, static type fluid mixing is defined herein as that mixing which is carried out using structure without moving parts, through which a fluid stream or streams of different fluids will flow.

As indicated by FIG. 1, prior art static type mixers act upon the different fluid constituents of a fluid stream with lateral intermixing. In other words the constituents are situated in the stream in a parallel fashion i.e. separated laterally as parts of the total stream. Thus, the mixing which is obtained by such prior art (static) type mixers will divert portions of the total stream in a lateral manner and the different constituents will be mixed together. For example, a conduit 11 may be carrying a stream of two different fluids 12 and 13 (designated A and B) which are separated laterally across the stream within the conduit 11, as illustrated. These constituent fluids would be introduced into a static mixing element 16 where different portions of the total stream would be diverted so as to flow laterally and mix with one another, as indicated by arrows 17. This would result in a mixed stream of fluids 18 (A + B) in a continuation of the conduit 11. However, it will be observed that if the separate fluids 12 and 13 had been substantial quantities relative to the length of the mixing element 16 and were separated batch wise, or longitudinally in the conduit 11, then the mixing would be relatively ineffective except at the interfaces of the separate fluids.

FIGS. 2 illustrates the principles of a static-type mixing procedure according to this invention. It will be appreciated from this diagramatic illustration that it is highly effective in cases where different fluids to be mixed are longitudinally separated along a stream of fluid. Thus, in FIG. 2 there is schematically illustrated a conduit 21 that has separate fluids 22 and 23 (designated A and B) which are separated longitudinally therein. It will be understood that the relative dimensions of the longitudinal extent of the fluids 22 and 23 versus the diameter of the conduit 21 are not intended to be technically accurate. They merely indicate the principles involved.

When the fluids 22 and 23 flow into a mixing element 26, the mixing procedure according to this invention causes back mixing longitudinally, as indicated by arrows 27. Consequently, a totally mixed stream 30 will be flowing in the extension of the conduit 21 or at the outlet of the element 26.

The mixing obtained is especially effective for different fluids that are separated longitudinally, i.e. as schematically indicated. Basically, a method according to this invention involves the following steps. One is that of flowing a stream of a plurality of different fluids, e.g. fluids 22 and 23, in a conduit, e.g. the conduit 21, for containing such fluids. Another step involves separating the flowing stream by diverting a portion transversely of the stream (not illustrated in FIG. 2) and then longitudinally reversing the remainder of the stream so as to rejoin the separated portion after a predetermined amount of continuing flow of the stream. This is schematically indicated in FIG. 2 by the arrows 27. It will be understood that after the undiverted portion has rejoined the separated portion they will mix together and so accomplish the longitudinal mixing desired.

Figure 3:
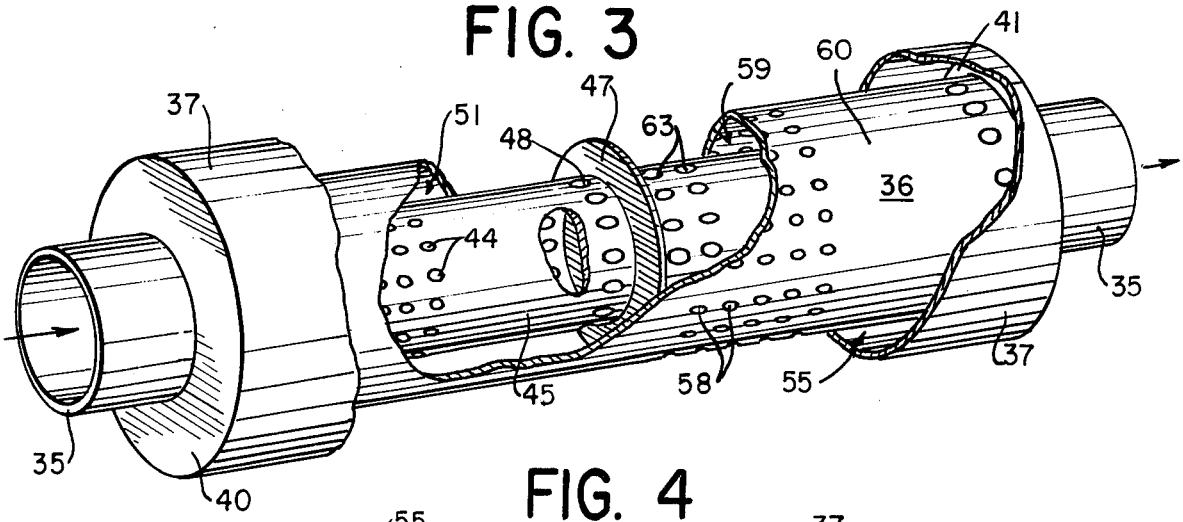
FIG. 3 is a perspective view showing a static mixer according to this invention.
Figure 4:
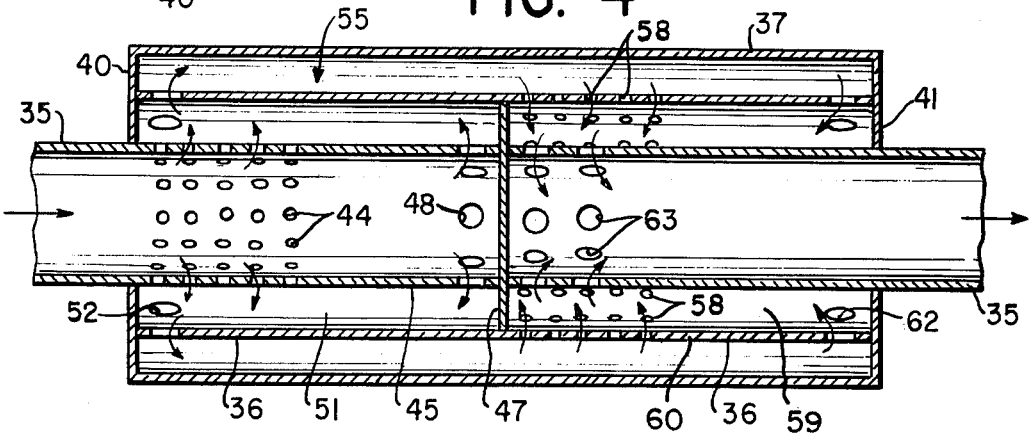
FIG. 4 is a longitudinal cross-sectional view of a mixer according to FIG. 3.

FIGS. 3 and 4 illustrate an embodiment of a mixer according to this invention. There is a conduit 35 which is for carrying a stream of fluid that has constituents thereof separated longitudinally in the conduit. The mixer includes inner and outer conduits 36 and 37 which surround the conduit 35. These form an enclosed mixing section within the outer conduit 37. There are end walls 40 and 41 that join the outside of the conduit 35 in a fluid tight manner.

Inside the mixer, or downstream from the end wall 40 there are a plurality of relatively small passages 44 thru the walls of the conduit 35, so as to divert a portion of the stream flowing in the conduit 35. The remainder of the stream will continue within an imperforate section 45 of the conduit 35 until it reaches an end wall 47 that is fastened in a fluid tight manner so as to close off the conduit 35 at that point.

There are a plurality of larger passages 48 situated adjacent to the end wall 47. These passages 48 extend through the walls of the conduit 35 at the down stream end of the imperforate section 45 so that the remainder of the fluid stream will pass through these openings 48 into annular space or chamber 51. It will be noted that the end wall 47 extends radially out beyond the conduit 35 and is fastened to the inside of the conduit 36 in a fluid tight manner. Consequently, the remaining portion of the stream that flows on along the section 45 of the conduit 35 will go through the passages 48 and will be reversed in direction and flow back along the annular chamber 51 to join the diverted portion of the stream that already flowed through the passages 44.

The conduit 36 has a plurality of relatively large passages 52 that are adjacent to the end wall 40. As already indicated above, the end wall 40 is attached in a fluid tight manner to the ends of the conduits 36 and 37. Consequently, the fluid stream which now includes both the diverted portion and the remainder mixed together, will flow through the passages 52 and be reversed again, or re-reversed to flow in the original direction within another outer annular chamber 55.

There is another group of relatively small passages 58 through the walls of the conduit 36. These are located down stream and beyond the end wall 47. These passages 58 will divert a portion of the mixed stream that is flowing in the annular chamber 55, into another annular chamber 59 that is formed between the inside of conduit 36 and the outside of the extension of the conduit 35. The remainder of the mixed fluid stream will continue to flow in the chamber 55, past an imperforate section 60 of the conduit 36 until it reaches the other end wall 41. Adjacent to the end wall 41 there are a plurality of relatively large passages 62 through the walls of the conduit 36. Consequently the undiverted remainder of the mixed stream will be reversed and will flow along the chamber 59 to join the diverted portion.

Adjacent to the end wall 47 there are a plurality of relatively large passages 63. These will accommodate the stream of fluids which has been through two stages of longitudinal, or back mixing, in accordance with this invention. The direction of flow is re-reversed once more on account of the end wall 47, and the mixture continues beyond the mixing section which is located between the two outside end walls 40 and 41.

Figure 5:
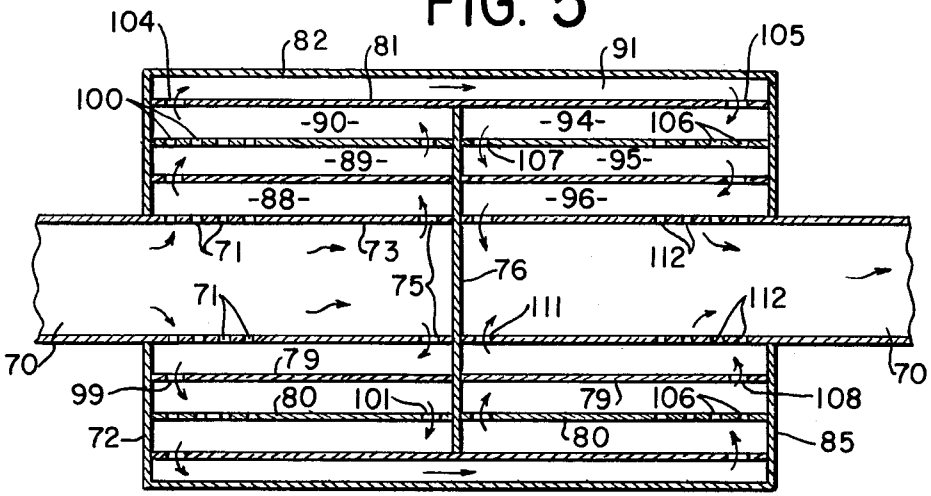
FIG. 5 is a schematic cross-sectional showing of a modified form of static mixer according to the invention.

FIG. 5 illustrates a different modification of a mixer according to the invention. This has a conduit 70 with plural relatively small passages 71 that are located on the inside of an outer end wall 72. The passages 71 are limited in size so that only a portion of the fluid flowing in the conduit 70 will pass through these passages while the remainder flows on through an imperforate section 73 of the conduit 70, to a plurality of larger passages 75 that are located adjacent to a closed end wall 76.

There are four concentric conduits 79, 80, 81 and 82 that surround the conduit 70. These extend between the outer end wall 72 and another similar end wall 85 to form a mixing section of this modification. The inner end wall 76 extends radially outward and forms closed end walls for annular chambers formed between the conduits 70, 79, 80 and 81. These chambers are radially disposed adjacent to one another and act alternately to provide the longitudinal mixing according to this invention similarly as that indicated above in connection with FIGS. 3 and 4. Thus, these annular chambers are designated by reference numbers 88, 89 and 90 on the left hand end of the FIG. 5 illustration.

There is an outer annular chamber 91 which extends the full length of the conduit 82. This encloses the mixing section, and there are annular chambers 94, 95 and 96 situated radially. inside one another. These are located on the right hand end of the mixer illustrated in FIG. 5, and they also provide longitudinal mixing similarly as the right hand end of the FIGS. 3 and 4 modification.

It will be observed that there are a plurality of relatively large passages 99 through the conduit 79 near the end wall 72. Also, in the conduit 80 there are a plurality of relatively smaller passages 100 adjacent to the end wall 72, and a plurality of relatively large passages 101 through the conduit 80 near the inner end wall 76. The conduit 81 has a plurality of relatively large passages 104 through near the end wall 72, while the outer conduit 82 has no passages therethrough since it encloses the unit and provides the annular passage 91 between it and the conduit 81.

The right hand side of the unit as illustrated in FIG. 5 substantially duplicates the left hand side but in reverse. Consequently, there are a plurality of relatively large passages 105 through the conduit 81 near the end wall 85. Also, there are relatively small passages 106 located through the conduit 80 near the end wall 85, while there are relatively large passages 107 through the same conduit 80 near the inner end wall 76. There are a plurality of relatively large passages 108 through the conduit 79 near the end wall 85, and the conduit 70 extended has a plurality of large passages 111 located adjacent to the inner end wall 76. Also there are a plurality of relatively smaller passages 112 located through the conduit 70 near the outer end wall 85.

It will be appreciated from the above description relating to FIGS. 3 and 4 and that the FIG. 5 modification acts substantially the same way but it has added two stages more than the two shown in FIGS. 3 and 4. It will be clear from the illustration of FIG. 5 which has arrows to indicate the fluid flow paths, that the action is substantially like that already described above in connection with FIGS. 3 and 4.

Figure 6:
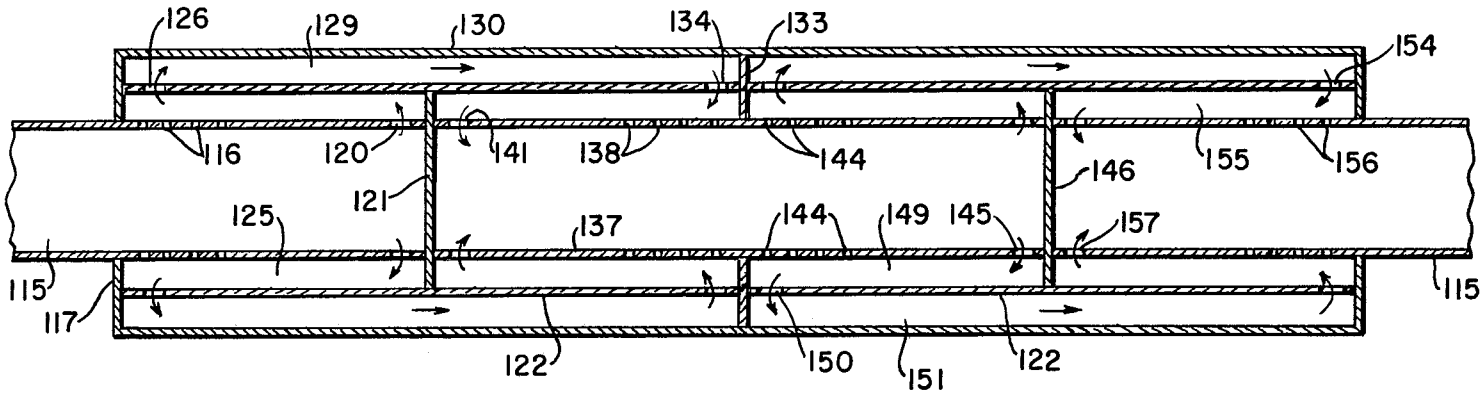
FIG. 6 is another schematic cross-sectional view showing still another modification of a static mixer according to this invention.

FIG. 6 illustrates another embodiment of the invention wherein there are four stages of mixing, but these are designed to have a smaller outside diameter. Thus, in FIG. 6 there is an inlet conduit 115 that has small passages 116 therethrough on the inside of an outer end wall 117. There are larger passages 120 adjacent to an inner end wall 121 which extends radially to contact a concentric conduit 122. Consequently, the fluid flowing through passages 120 must return along an annular chamber 125 to join the diverted fluid through the passages 116. The mixed fluid then flows through larger passages 126 that go through the conduit 122 adjacent to the end wall 117. The fluid then flows along an annular chamber 129 which is located inside an outer imperforate conduit 130. In this modification, there is an annular end wall 133, adjacent to which there are large passages 134 which go through the conduit 122.

The conduit 115 extended has an inner section 137 that has a set of smaller passages 138 therethrough which are located to the left of the annular end wall 133 (as viewed in FIG. 6). There are also large passages 141 through the conduit section 137 where the remainder of the fluid flows after the portion has been diverted through passages 138.

The right hand end of the structure of FIG. 6 is substantially identical with the left hand end. Thus, the fluid flow again is mixed with a backflow reversal. It goes through a plurality of small passages 144 in part, and the remainder goes through larger passages 145 located adjacent to another inner end wall 146. The end wall 146 extends into fluid tight sealing relationship with the conduit 122 extended, so that the fluids flowing through the passages 145 are returned back inside an annular chamber 149. Here they join and mix with the diverted portion that flowed through the passages 144, and the mixture passes through a plurality of large passages 150 into an annular chamber 151. Finally, the fluid flows through plural large passages 154 into an annular chamber 155 where they are again partially diverted through a plurality of smaller passages 156. The remainder of the fluid flows back to plural larger passages 157 that are adjacent to the end wall 146. Consequently, the completely mixed fluid flows on out through the conduit 115 extended.

While particular embodiments of the invention have been described above in considerable detail, this is not to be taken as in any way limiting the invention but merely as being descriptive thereof.

We claim:

1. A static-type plural fluids mixer, comprising in combination an imperforate first conduit forming an inlet for carrying longitudinally separated batches of said fluids therein, said batches forming a continuous stream of said fluids, a plurality of relatively small passages through the walls of said first conduit at a predetermined location down stream from said inlet for laterally diverting a portion of said stream, an imperforate section of said first conduit down stream from said predetermined location for carrying all of the remainder of said stream a relatively substantial distance down stream from said predetermined location, means for reversing the direction of flow of said remainder of said stream back toward said predetermined location, comprising a relatively large passage at the down stream end of said imperforate section, an end wall on said first conduit adjacent to and down stream from said relatively large passage, a second imperforate conduit concentric with said first conduit, said end wall extending laterally and forming the end wall of said second imperforate conduit, said second conduit extending back at least to said predetermined location for carrying said remainder back to join with said portion of said stream, and means forming an outlet for carrying said mixed stream.

2. A static-type mixer according to claim 1, further comprising means for longitudinally re-reversing said stream after said rejoinder.

3. A static-type mixer according to claim 2, wherein said means for re-reversing said stream after said rejoinder comprises a second relatively large passage at the down stream end of said second imperforate conduit, another end wall on said second imperforate conduit adjacent to and down stream from said second relatively large passage, a third imperforate conduit concentric with said first and second conduits, said other end wall on said second conduit extending laterally and forming the end wall of said third imperforate conduit.

4. A static-type plural fluids mixer, comprising in combination an imperforate first conduit forming an inlet for carrying longitudinally separated batches of said fluids therein, said batches forming continuous stream of said fluids, second and third conduits concentric with said first conduit and having end walls common to both said second and third conduits, said end walls joining with and extending radially from the outside walls of said first conduit, a first plurality of relatively small passages through the wall of said first conduit downstream from one of said end walls for passing only a portion of said stream laterally therethrough into a first annulus between said first and second conduits, a first imperforate section of said first conduit located downstream from said first plurality of passages, a second plurality of relatively large passages through the wall of said first conduit downstream from said first imperforate section of said first conduit for passing the remainder of said stream into said first annulus between said first and second conduits, an inner end wall on said first conduit located downstream from said second plurality of passages and extending radially outside of said first conduit to join with the inside walls of said second conduit, said inner end wall forming one end of said first annulus for receiving and reversing the direction of flow of said remainder of said stream back to join said portion thereof at the other end of said first annulus, a third plurality of relatively large passages through the wall of said second conduit at said other end of said first annulus for passing said rejoined stream into a second annulus between said second and third conduits, a fourth plurality of relatively small passages through the wall of said second conduit downstream from said inner end wall for passing only a portion of said rejoined stream laterally therethrough into a third annulus between said second and said first conduits, a second imperforate section of said second conduit located downstream from said fourth plurality of passages, a fifth plurality of relatively large passages through the wall of said second conduit downstream from said second imperforate section of said second conduit for passing the remainder of said rejoined stream into said third annulus between said second and first conduits, said fifth plurality of passages being located adjacent to the other of said end walls common to said second and third conduits, said other of said end walls forming one end of said third annulus for receiving and reversing the direction of flow of said remainder of said rejoined stream back to join said portion thereof at the other end of said third annulus, a sixth plurality of relatively large passages through the wall of said first conduit at said other end of said third annulus for passing said re-rejoined rejoined stream into said first conduit on the downstream side of said inner end wall, and a third imperforate portion of said first conduit forming an outlet for said mixed plural fluids.

* * * * *